US007497971B2

(12) United States Patent
Donzé et al.

(10) Patent No.: US 7,497,971 B2
(45) Date of Patent: Mar. 3, 2009

(54) MIXTURES OF FLUORESCENT WHITENING AGENTS

(75) Inventors: Jean-Jacques Donzé, Blodelsheim (FR); Marie Meyberger, Bouxwiller (FR); Michael Milde, Grenzach-Wyhlen (DE); Volker Papendick, Steinen (DE); Josef Zelger, Riehen (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 399 days.

(21) Appl. No.: 10/537,062

(22) PCT Filed: Dec. 1, 2003

(86) PCT No.: PCT/EP03/50913

§ 371 (c)(1),
(2), (4) Date: Jun. 1, 2005

(87) PCT Pub. No.: WO2004/053221

PCT Pub. Date: Jun. 24, 2004

(65) Prior Publication Data

US 2006/0048309 A1 Mar. 9, 2006

(30) Foreign Application Priority Data

Dec. 10, 2002 (EP) ..... 02406084

(51) Int. Cl.
*C09K 11/06* (2006.01)

(52) U.S. Cl. ..... 252/301.21; 252/301.22; 8/549; 8/648

(58) Field of Classification Search ..... 252/89, 252/301.21, 301.22; 8/648, 549
See application file for complete search history.

(56) References Cited

U.S. PATENT DOCUMENTS

| | | | | |
|---|---|---|---|---|
| 4,008,166 | A | 2/1977 | Luthi | 252/89 |
| 4,105,399 | A | 8/1978 | Luthi | 8/1 |
| 4,778,623 | A | 10/1988 | Guglielmetti | 252/301.21 |
| 4,785,128 | A | 11/1988 | Guglielmetti | 558/411 |
| 5,001,253 | A | 3/1991 | Guglielmetti | 558/415 |
| 5,051,111 | A * | 9/1991 | Anceschi et al. | 8/648 |
| 5,053,055 | A * | 10/1991 | Fringeli et al. | 8/648 |
| 6,120,704 | A * | 9/2000 | Martini et al. | 252/301.21 |
| 6,719,922 | B1 * | 4/2004 | Reinehr et al. | 252/301.21 |
| 2003/0192137 | A1 | 10/2003 | Cuesta et al. | 8/518 |
| 2005/0106114 | A1 | 5/2005 | Metzger et al. | 424/59 |
| 2005/0120490 | A1 | 6/2005 | Metzger et al. | 8/115.51 |

FOREIGN PATENT DOCUMENTS

| | | |
|---|---|---|
| DE | 3313332 | 10/1984 |
| EP | 0 030 917 | 6/1981 |
| EP | 0 240 461 | 10/1987 |
| WO | 99/05356 | 2/1999 |

* cited by examiner

*Primary Examiner*—Jessica L. Ward
*Assistant Examiner*—John A Hevey
(74) *Attorney, Agent, or Firm*—Shiela A. Loggins

(57) ABSTRACT

The present invention relates to a mixture of fluorescent whitening agents comprising 11 to 20% by weight of a compound of formula (1), and 80 to 89% by weight of a compound of formula (2), wherein $R_1$ denotes hydrogen, $C_1$-$C_6$alkyl, $C_5$-$C_{14}$aryl or $C_6$-$C_{24}$aralkyl and X is a bivalent radical of formula (3), (4) or (5) compositions containing the mixture and the use of the compositions for whitening synthetic fibers, in particular, polyester.

(1)

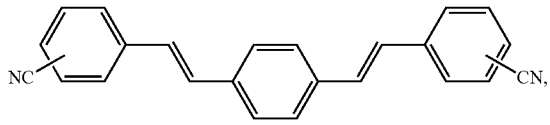

(2)

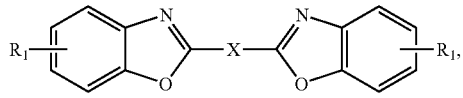

(3)

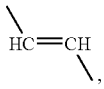

(4)

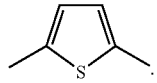

(5)

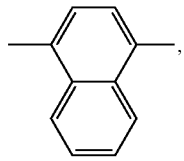

13 Claims, No Drawings

MIXTURES OF FLUORESCENT WHITENING AGENTS

The present invention relates to mixtures of fluorescent whitening agents (FWAs) based on dicyano-1,4-bis-styryl-benzenes and bisbenzoxazoles.

Fluorescent whitening agents are often used in the form of mixtures of two or more components, since such mixtures may exhibit a higher degree of whiteness than that of the sum of the individual components alone.

Thus, for example, GB 2200660 describes mixtures of 2,3'-, 2,4'- and 4,4'-dicyano-1,4-bis-styrylbenzenes, although the composition is restricted by the method of preparation, whilst U.S. Pat. No. 5,695,686 describes similar asymmetric mixtures containing further isomers again due to the process of preparation.

According to EP 44 996, high degrees of whiteness can also be achieved by application of mixtures of specific bis-benzoxazoles.

The constitution of such mixtures of FWAs is important not only in regard to their whitening effects, but also with regard to the shade, which may be more or less bluish, reddish or greenish, the desirability being a matter of utmost importance to the end user.

It has now, surprisingly, been found that high degrees of whiteness in especially desirable bluish shades are obtained from mixtures of fluorescent whitening agents comprising 11 to 20% by weight of a compound of formula (1)

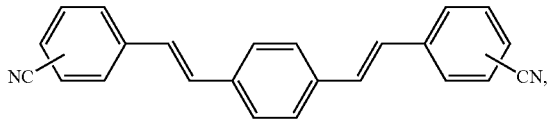

and 80 to 89% by weight of one or more compounds of formula (2)

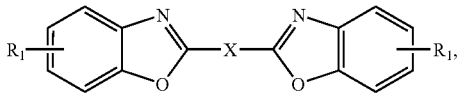

wherein $R_1$ denotes hydrogen, $C_1$-$C_6$alkyl, $C_5$-$C_{14}$aryl or $C_6$-$C_{24}$aralkyl and X is a bivalent radical of formula (3), (4) or (5)

(3)

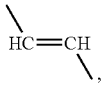

(4)

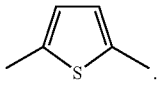

-continued (5)

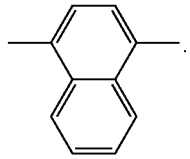

Furthermore, mixtures comprising 13 to 17% by weight, more preferably 14 to 16% by weight, of the compound of formula (1) and 83 to 87% by weight, more preferably 84 to 86% by weight, of the compound of formula (2) are of particular interest.

The compounds of formulae (1) and (2) are well-known FWAs and commercially available or can be prepared according to well-known methods.

$C_1$-$C_6$alkyl as $R_1$ includes for example methyl, ethyl, propyl, isopropyl, n-butyl, isobutyl, sec-butyl, tert-butyl, amyl, tert-amyl(1,1-dimethylpropyl)n-pentyl, neopentyl, and n-hexyl.

Examples for $C_5$-$C_{14}$aryl are phenyl, tolyl, mesityl, isityl, xylyl, naphthyl, anthryl and phenanthryl.

$C_6$-$C_{24}$aralkyl as $R_1$ includes for example benzyl, 2-phenylethyl, diphenylmethyl, naphthylmethyl and 2-naphthylethyl.

Preferably, the mixtures according to the invention contain a compound of formula (1a)

(1a)

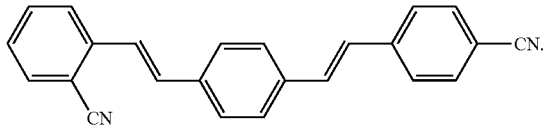

Further preferred mixtures according to the invention contain a compound of formula (2a)

(2a)

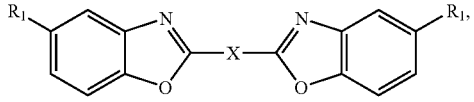

wherein $R_1$ and X are as defined above.

Preferred compounds of formula (2a) are those wherein $R_1$ denotes hydrogen or $C_1$-$C_6$alkyl.

Especially preferred are the compounds of formulae (2b) and (2c).

(2b)

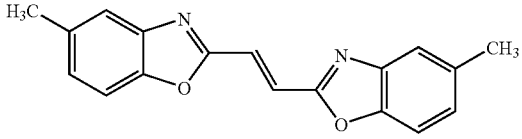

-continued (2c)

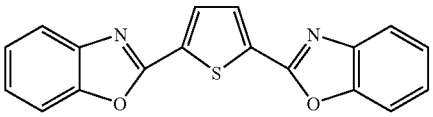

Further particularly preferred mixtures according to the invention contain 13 to 17% by weight, most preferably 14 to 16% by weight, of a compound of formula (1a) and 83 to 87% by weight, most preferably 84 to 86% by weight, of a compound of formula (2c).

Further objects of the present invention are the use of the mixtures of the compounds of the formulae (1) and (2) for whitening synthetic fibres, in particular polyester fibres, said compositions containing a mixture comprising 5 to 60% by weight of a compound of formula 1 and 40 to 95% of a compound of formula (2).

As is customary with mixtures of fluorescent whitening agents, the individual components can be processed to the commercial form by dispersing them in a liquid medium, preferably water. This can be done by dispersing the individual components and then combining the dispersions so obtained. However, it is also possible to mix the individual components together in substance and then to disperse them jointly. The dispersing operation is carried out in a conventional manner in ball mills, colloid mills, bead mills or the like.

The present invention thus further provides brightener compositions containing water and, in each case based on the weight of the formulation, from 3 to 25% by weight, preferably from 10 to 20% by weight of the above defined fluorescent whitening agent mixture and also 0 to 60%, preferably 5 to 50% by weight, of auxiliaries.

Suitable auxiliaries include, for example, dispersing and wetting agents, antifreezes, antifoams, thickeners/stabilizers and biocides.

Examples for anionic dispersants are condensates of aromatic sulfonic acids as well as ligninsulfonates, alkyl aryl sulfonates, alkyl diphenyl oxide sulfonates, sulfates or phosphates of ethoxylated alkyl phenols, di- or tristyrylphenols.

Examples for non-ionionic dispersants are ethylene oxide adducts with fatty alcohols, higher fatty acids, alkyl phenols, sorbitol esters, di- and tristyrylphenol; copolymers of ethylene oxide and propylene oxide or ethylenediamine ethylene oxide/propylene oxide adducts.

Examples for thickeners/stabilizers are copolymers of N-vinylpyrrolidone with 3-vinylpropionic acid, polyvinylalcohols or non-ionic/anionic polysaccharides.

All types of formulation auxiliaries are described in McCutcheon's year books of Emulsifiers & Detergents and Functional Materials.

The mixtures of this invention and the compositions containing them are suitable for whitening textile materials made from synthetic fibres, in particular, those made from linear polyesters. However, these mixtures and compositions can also be used for whitening blends that contain linear polyesters.

The mixtures of this invention are applied by the methods normally employed for the application of fluorescent whitening agents, for example, by the exhaust dyeing process in dyeing machines or by pad-thermofixation. The treatment is conveniently effected in an aqueous medium in which the compounds are present in finely particulate form as suspensions, microdispersions or, as the case may be, solutions. If appropriate, dispersants, stabilisers, wetting agents and other assistants can be added during the treatment. The treatment is normally carried out in the temperature range from about 20° C. to 140° C., preferably 110 to 130° C., for example, at the boiling temperature of the bath or in the proximity thereof. Where the mixtures are applied by the pad-thermofixation process, the thermofixing is preferably carried out at a temperature of between 170 and 200° C.

The mixtures according to the invention provide a blue shade without the addition of shading dyes.

Furthermore, the materials treated with the mixtures according to the invention exhibit a high lightfastness as well as a high whiteness level and excellent brilliancy.

The following Examples serve to illustrate the invention; parts and percentages are by weight, unless otherwise stated.

EXAMPLES

Polyester fabrics are treated with mixtures containing the compounds of formulae (1a) and (2b) or (2c), respectively, and analysed with respect to degree of whiteness according to Ganz, lightfastness according to ISO 105-B02, tint value TV according to Ganz-Griesser, lightness L* according to the CIELAB system and brightness B (D65) according to ISO 2470. The results are summarised in Tables 1a, 1b, 2a and 2b.

(1a)

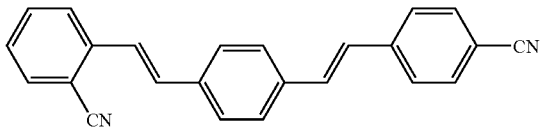

(2b)

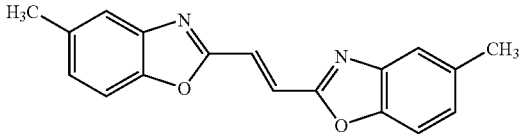

(2c)

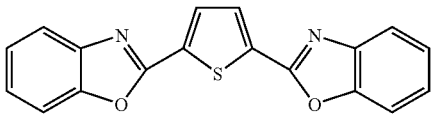

Example 1 a) Application on Polyester in Exhaust Process

A polyester fabric (prescoured, heat-set at 195° C., 165 g/m$^2$) is treated, in a dyeing apparatus, at room temperature and at a liquor ratio of 1:20, with an aqueous bath containing a mixture of the optical brightening agents of formula (1a) and (2c) in the ratios given in Table 1, in finely dispersed form and in the presence of 1 g/l of a fatty alcohol polyglycol ether as dispersing agent. The temperature is raised from room temperature to 130° C. over 30 minutes, held for a further 30 minutes at this temperature and subsequently cooled to 40° C. during 15 minutes. The textile material is then rinsed for 30 seconds under running water and dried at 70° C.

TABLE 1a

| FWA Mixture | Concentration | Ganz Whiteness | Lightfastness |
|---|---|---|---|
| (2c) + (1a) (80:20) | 0.09% | 206 | 7 |
| (2c) + (1a) (85:15) | 0.08% | 206 | 7 |

b) Application on Polyester in Pad-bake Process

A polyester fabric (prescoured, heat-set at 195° C., 165 g/m$^2$) is treated at room temperature by the pad-bake process with an aqueous liquor containing a mixture of the optical brightening agents of formula (1a) and (2c) in the ratios given in Table 1, in dispersed form and in the presence of 1 g/l of an alkali salt of a sulfonated dicarboxylic acid alkyl ester. The liquor pick-up is 50%. Subsequently, the fabric sample is dried for 30 minutes at 70° C. and then thermofixed during 30 seconds at 180° C.

TABLE 1b

| FWA Mixture | Concentration | Ganz Whiteness |
|---|---|---|
| (2c) + (1a) (80:20) | 1.20 g/l | 200 |
| (2c) + (1a) (85:15) | 1.20 g/l | 207 |

Example 2

A polyester fabric (prescoured, heat-set at 195° C., 165 g/m$^2$) is treated by the exhaust process and by the pad-batch process, respectively, as described in Example 1.

The Ganz whiteness, tint value, lightness and brightness of the treated samples are given in Tables 2a and 2b.

TABLE 2a

| (exhaust process): | | | | | |
|---|---|---|---|---|---|
| FWA Mixture | Concentration | Ganz Whiteness | TV | L* | B (D65) |
| (2c) + (1a) (80:20) | 0.09% | 206 | 0.58 | 97.68 | 111.2 |

TABLE 2b

| (pad-bake process): | | | | | |
|---|---|---|---|---|---|
| FWA Mixture | Concentration | Ganz Whiteness | TV | L* | B (D65) |
| (2c) + (1a) (80:20) | 1.8 g/l | 200 | 0.84 | 97.36 | 112.3 |

The invention claimed is:

1. A mixture of fluorescent whitening agents comprising 13 to 17% by weight of a compound of formula (1)

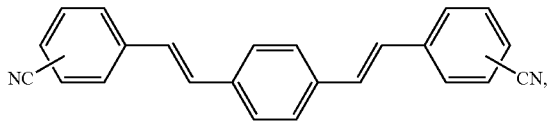

and 83 to 87% by weight of one or more compounds of formula (2)

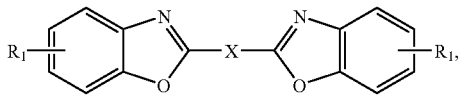

wherein $R_1$ denotes hydrogen, $C_1$-$C_6$alkyl, $C_5$-$C_{14}$aryl or $C_6$-$C_{24}$aralkyl and X is a bivalent radical of formula (3), (4) or (5)

(3)

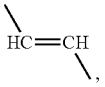

(4)

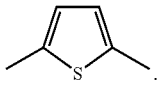

(5)

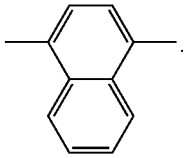

2. A mixture according to claim 1 comprising a compound of formula (1a)

(1a)

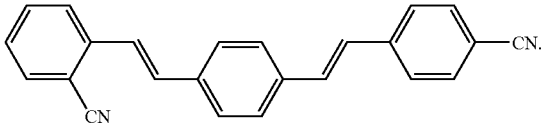

3. A mixture according to claim 1 comprising a compound of formula (2a)

(2a)

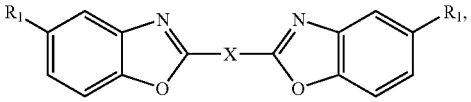

wherein $R_1$ and X are as defined in claim 1.

4. A mixture according to claim 3 comprising a compound of formula (2a) wherein $R_1$ denotes hydrogen or $C_1$-$C_6$alkyl.

5. A mixture according to claim 3 comprising a compound of formula (2a) wherein $R_1$ denotes methyl and X is a bivalent radical of formula (3).

6. A mixture according to claim 3 comprising a compound of formula (2a) wherein $R_1$ denotes hydrogen and X is a bivalent radical of formula (4).

7. A composition, which contains water, a mixture of fluorescent whitening agents according to claim 1 and, optionally, auxiliaries.

8. A composition according to claim 7 containing water and, based on the total weight of the formulation, from 3 to 25% by weight of the fluorescent whitening agent mixture and 0 to 60% of auxiliaries.

9. A composition according to claim 8 containing water and, based on the total weight of the formulation, from 10 to 20% by weight of the fluorescent whitening agent mixture and 5 to 50% by weight of auxiliaries.

10. A method of whitening synthetic fibres, which comprises contacting said fibres in an aqueous medium with a fluorescent whitening agent mixture according to claim 1.

11. A method of whitening synthetic fibres, which comprises contacting said fibres in an aqueous medium with a fluorescent whitening agent composition according to claim 7.

12. A method according to claim 10, wherein the synthetic fibres comprise polyester fibres.

13. A method of whitening synthetic fibres, which comprises contacting said fibres in an aqueous medium with a fluorescent whitening agent mixture according to claim 2.

* * * * *